US012709837B2

(12) United States Patent
Abbas et al.

(10) Patent No.: US 12,709,837 B2
(45) Date of Patent: Aug. 18, 2026

(54) PRE-ULTRAVIOLET RADIATION PROTECTIVE ADDITIVES FOR TEXTILES AND METHODS OF USE

(71) Applicant: Claros Technologies Inc., Minneapolis, MN (US)

(72) Inventors: Abdennour Abbas, Falcon Heights, MN (US); Andrew Gonzalez, Crystal, MN (US); John Wilfrid Brockgreitens, Minneapolis, MN (US)

(73) Assignee: Claros Technologies Inc., Minneapolis, MN (US)

( * ) Notice: Subject to any disclaimer, the term of this patent is extended or adjusted under 35 U.S.C. 154(b) by 482 days.

(21) Appl. No.: 18/312,255

(22) Filed: May 4, 2023

(65) Prior Publication Data

US 2023/0357985 A1 Nov. 9, 2023

Related U.S. Application Data

(60) Provisional application No. 63/338,092, filed on May 4, 2022.

(51) Int. Cl.
*D06M 15/15* (2006.01)
*D06M 13/238* (2006.01)
(Continued)

(52) U.S. Cl.
CPC ..... *D06M 15/15* (2013.01); *D06M 13/238* (2013.01); *D06M 2101/06* (2013.01); *D06M 2101/32* (2013.01); *D06M 2200/25* (2013.01)

(58) Field of Classification Search
CPC . Y10T 442/259; D06M 15/15; D06M 13/238; D06M 2101/06; D06M 2101/32;
(Continued)

(56) References Cited

U.S. PATENT DOCUMENTS 3,929,697 A * 12/1975 Morrill ..... D06P 1/52 427/389.9
6,034,003 A * 3/2000 Lee ..... D06P 1/65112 442/131
(Continued)

FOREIGN PATENT DOCUMENTS

CN 105970672 A * 9/2016 ..... D06P 5/08
CN 108998974 A 12/2018
(Continued)

OTHER PUBLICATIONS

Koopman, Ann-Kathrin et al "Tannin-Based Hybrid Materials and Their Applications: A Review"; Molecules 2020; 25, 4910 (Year: 2020).*
(Continued)

*Primary Examiner* — Jennifer A Steele
(74) *Attorney, Agent, or Firm* — Padda Law Group

(57) ABSTRACT

Ultraviolet protective textiles and methods of making ultraviolet protective textiles including a sheet substrate comprising a synthetic, semi-synthetic or natural textile or blend thereof, a UV absorbing chemical present on the substrate, and a capping agent bound to the UV absorbing chemical. The UV absorbing chemical may be an organic acid, protein, flavonoid, or a polyphenolic compound, for example, such as tannic acid. The capping agent may be an alkylbenzene based surfactant, phenylethanoid, monophenol, or protein, for example, such as whey or casein.

17 Claims, 4 Drawing Sheets

(51) Int. Cl.
*D06M 101/06* (2006.01)
*D06M 101/32* (2006.01)

(58) Field of Classification Search
CPC ..... D06M 2200/25; D06M 13/152; D06M 13/2035; D06M 13/368
See application file for complete search history.

(56) References Cited

U.S. PATENT DOCUMENTS

| | | | |
|---|---|---|---|
| 6,194,330 | B1 | 2/2001 | Vogt et al. |
| 2004/0074012 | A1 | 4/2004 | Heidenfelder et al. |

FOREIGN PATENT DOCUMENTS

| | | | | | |
|---|---|---|---|---|---|
| CN | 109355918 | A | | 2/2019 | |
| CN | 111286980 | A | * | 6/2020 | ..... D06M 15/263 |
| EP | 0655061 | B1 | * | 4/2002 | ..... D06M 13/385 |

OTHER PUBLICATIONS

Grifoni, Daniele et al; "UV protective properties of cotton and flax fabrics dyed with multifunctional plant extracts." Elsevier, Dec. 2013 (Year: 2013).*

Machine Translation CN105970672 (Year: 2016).*

Srisod, S; "A green and facile approach to durable antimicrobial coating of cotton silver nanoparticles, whey protein and natural tannin"; Elsevier; Mar. 2018 (Year: 2018).*

Pisitak, P; "Improving the dyeability of cotton with tannin-rich natural dye through pretreatment with whey protein isolate"; elsevier; Jun. 2015 (Year: 2015).*

Grifoni; "The role of natural dyes in the UV protection of fabrics made of vegetable fibers"; elsevier; Dec. 2010 (Year: 2010).*

Son, Ho Yeon; "Tannin-Titanium Oxide Multilayer as Photochemically Suppressed Ultraviolet Filter"; Applied Materials; ACS Publications 2018 (Year: 2018).*

UV Protective Properties of cotton and flax fabric dyed with multifunctional plant extracts (Year: 2013).*

Jiang Protein Tannin Interactions for UV Fabric (Year: 2024).*

Machine Translation of CN111286980 (Year: 2020).*

International Search Report and Written Opinion for related PCT Application No. PCT/US2023/021012 mailed Aug. 31, 2023 (10 pages).

* cited by examiner

FIG. 5
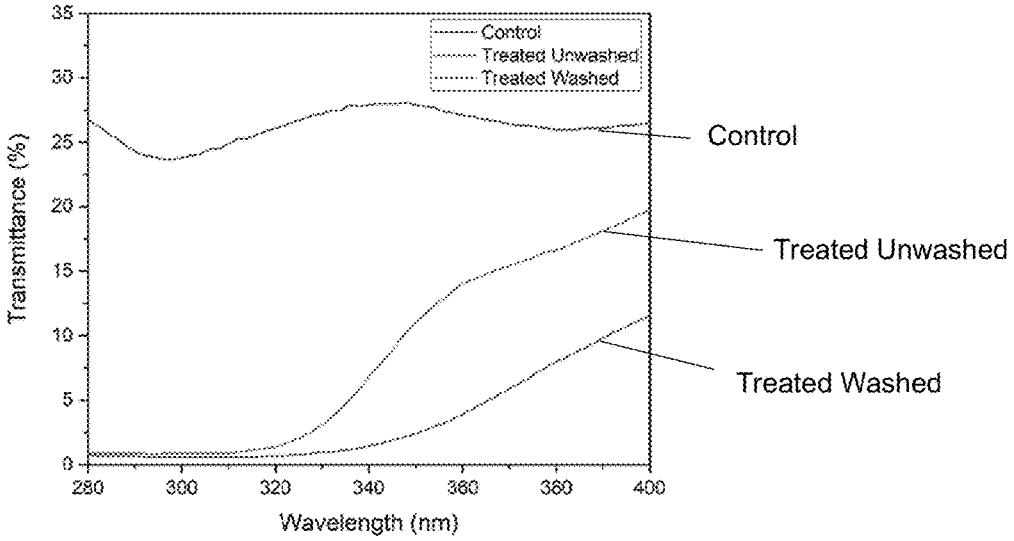
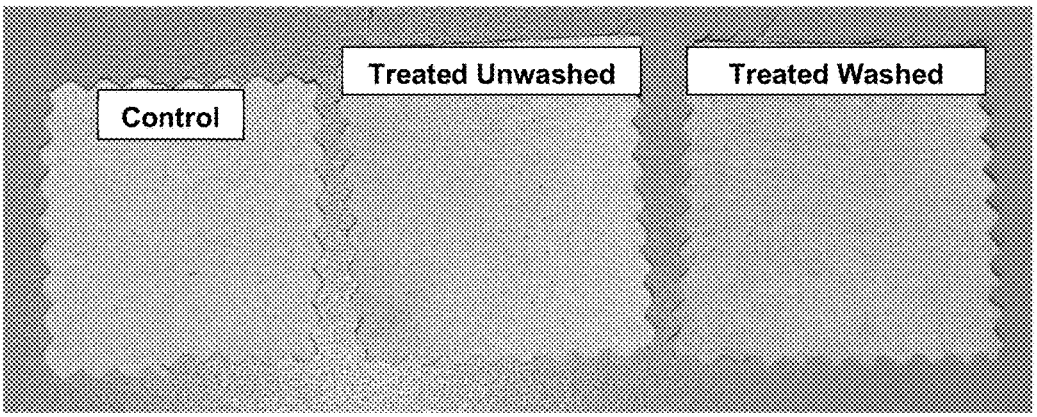
FIG. 6

PRE-ULTRAVIOLET RADIATION PROTECTIVE ADDITIVES FOR TEXTILES AND METHODS OF USE

BACKGROUND

Ultraviolet (UV) radiation can damage cells, and with prolonged exposure, is the leading cause of skin cancer in the world. UV damage can also be manifested through drying skin, premature skin aging, and can also cause eye conditions such as cataracts. Because of the high energy of ultraviolet rays, they can penetrate clouds, are reflected off of snow, and can even pass-through windows and windshields. To mitigate the damage of UV exposure, doctors recommend utilizing sunscreen with a SPF of at least 15, often 30, with reapplication every two hours.

Sun protective clothing is another important tool to help protect against the damage of UV radiation. The ability of an article of clothing to protect against ultraviolet light is described as an Ultraviolet Protection Factor (UPF) rating. According to the Skin Cancer Foundation, UPF indicates how much UV radiation a fabric allows to reach your skin. For example, a UPF 50 fabric blocks 98 percent of the sun's rays and allows two percent (1/50th) to penetrate, thus reducing your exposure risk significantly. A high UPF score can be achieved through a variety of different methods, most importantly: color, construction, and content. The addition of dyeing compounds to fabric usually improves the UPF performance of the resulting product due to the nature of the dyes applied. Organic dyes are generally aromatic compounds, or contain one or more benzene rings, which are known to absorb UV radiation. Over time, the backbone of these compounds is destroyed by absorbing these high energy rays, resulting in what is commonly known as "sun bleaching". The construction of the fabric is just as important, with a dense weave and thick fiber being more effective at blocking UV light. Unfortunately, UV radiation tends to be highest during sunny afternoons between 10 am and 4 pm, so in hot climates, thick shirting and fabrics are less desirable. To overcome this limitation, clothing articles with different fiber contents are employed. Synthetic fibers, such as polyester, nylon, and acrylic, are formed from long polymeric chains that have been formed from resins. These chains often include benzene rings, which as mentioned earlier, absorb the UV radiation. Because of this inherent protective feature, the majority of the outdoor fabrics market is dominated by synthetic fibers, or associated blends with natural fibers. Despite this, only about one third of all summer clothing even has a UPF rating above 15.

Current approaches for improving the UPF rating of natural fibers relies on chemical additives or surface treatments. Some research groups have shown the potential of coating cotton fibers with a thin layer of graphene, which can help to absorb the incoming UV rays and improve the performance of the fabric. While promising, the ability of this type of fabrication method to be scaled up to the level required by the textile industry is highly unlikely. Other techniques have been developed, such as the surface functionalization of the fibers with titanium dioxide nanoparticles, a common metal oxide additive used in sunscreen because of its ability to absorb UV radiation. Other nanoparticles or surface coatings have also been investigated by numerous organizations, however the main barrier is the ability to bind the active agent to the surface. Most treatment methods will wash off the cloth after several washes, reducing the UPF to initial levels, as well as contaminating wastewater streams with the active agent that was applied.

In terms of scalability and ease of use, chemical additives seem to be the better option. As mentioned previously, organic dyes often have great UV absorbing properties, with natural alternatives such as flavonoids and polyphenols being attractive options. Some research groups have utilized rutin, a naturally occurring flavonoid derived from plants such as citrus, to improve the UV protective characteristics of silk fibers. Unfortunately, none of these methods utilize a chemical that does not absorb in the visible spectrum and all will effectively discolor the underlying fabric in some way. The usefulness of chemical additives is therefore limited. Improvements are needed for enhancing the UV protection of textiles.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

FIG. 5 is a graph of transmittance vs wavelength of 100% cotton control and treated fabric samples resulting from Example 1;

FIG. 6 is a photograph of 100% cotton control and treated fabric samples resulting from Example 1;

SUMMARY

Figure 1:
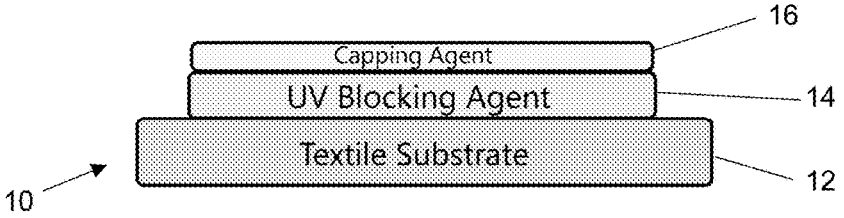
FIG. 1 is representative scheme of a textile substrate covered by a UV Blocking agent and a capping agent according to various embodiments.

Various embodiments include ultraviolet protective textiles. In some embodiments, the ultraviolet protective textile includes a sheet substrate comprising a synthetic, semi-synthetic or natural textile or blend thereof, a UV absorbing chemical present on the substrate, and a capping agent bound to the UV absorbing chemical. The UV absorbing chemical may be an organic acid, protein, flavonoid, or a polyphenolic compound, for example. In some embodiments, the UV absorbing chemical is an aromatic acid. In some embodiments, the UV absorbing chemical is gallic acid, tannic acid, salicylic acid, caffeic acid, dopamine, or ferulic acid. In other embodiments, the UV absorbing chemical is tannic acid. In some embodiments, the capping agent is an alkylbenzene based surfactant, phenylethanoid, monophenol, or protein. The capping agent may be a naturally derived protein, for example, such as whey or casein.

The ultraviolet protective textile may be a garment configured to be worn on the body of a user. The ultraviolet protective textile may have a coverage factor of greater than 97%.

The ultraviolet protective textile may be an organic porous material. The organic porous material also include inorganic components in the form of nanoparticles, coatings, or fibers.

Various embodiments include methods of making an ultraviolet protective material. In some embodiments, the method includes applying an ultraviolet absorbing organic compound in a solution to a porous material to diffuse the ultraviolet absorbing organic compound into the porous material and drying the porous material with the applied ultraviolet absorbing organic compound solution to bind the compound to a surface of the material and to interior fibers of the material. In some embodiments, drying the porous material includes heating the porous material. The ultraviolet absorbing organic compound may be tannic acid, for example.

In some embodiments, the method includes, after applying the ultraviolet protective material, applying a capping agent in a solution to the porous material to diffuse the capping agent into the porous material, either before or after drying the porous material. If the capping agent is applied after drying the porous material, the method may further include, after applying the capping agent, drying the porous material with the applied capping agent to bind the capping agent to the ultraviolet absorbing compound. The capping agent may be a naturally derived protein such as caseinate, for example. The porous material may be a textile.

DETAILED DESCRIPTION

This application claims priority to U.S. Provisional Application Ser. No. 63/338,092, entitled Pre-Ultraviolet Radiation Protective Additives for Textile and Methods of Preparation and Use, filed May 4, 2022, which is hereby incorporated by reference in the entirety.

Various inventions described herein include UV blocking textiles and methods of making the same. Various embodiments include chemical additives and application processes that increase the UPF rating of textiles, including textiles having natural cellulosic fibers, without discoloration of the textile. A wet chemical additive may be applied to the textile to saturate the textile, such as by spraying the textile or submerging the textile in a chemical bath. The textile may then be dried, such as by heating the textile, to achieve full dryness and fixation of the chemical to the yarns. In some embodiments, more than one chemical additive may be applied to the textile, such as in a sequential process, with optional drying of the textile between application of the chemicals.

Textiles treated as described herein have an improved ability to absorb ultraviolet light from the sun. In various embodiments, the chemical additive is a soluble functional compound that is applied to the textile surface and then heated until dry, bonding the functional compound to the fibers through forces such as ionic forces to prevent release during washing. The resulting fabric maintains the physical characteristics of the original textile with additional UV protection for the wearer.

The chemical additives used for the purpose of textile treatment according to various embodiments improve the ability of the fabric to block UV radiation and protect the consumer. In various embodiments, the chemical additives include a first composition and a second composition. The first composition may include one or more UV blocking compounds with known absorbance peaks in the UV range and/or significant absorbance in the UV range. The second composition may include one or more capping compounds. The capping compound may react with the first composition to ensure stability of the first composition on the substrate. For example, the capping compound may be selected to form chemical bonds to exposed reactive sites on the substrate-bound UV blocking compound. In this way, the capping compound may prevent the binding of other compounds such as inorganic compounds and/or other compounds to the UV blocking compound, which might otherwise cause a shift in the absorbance of the UV blocking compound and/or cause coloration of the underlying substrate.

A representative diagram of a textile substrate treated according to various embodiments is shown in FIG. 1. The treated textile 10 includes a textile substrate 12 that is coated with a UV blocking agent 14. A capping agent 16 is bound to the UV blocking agent 14. In this way, the capping agent 16 decreases or prevents any reactive sites present in the UV blocking agent 14 from reacting with other compounds which may interfere with its UV blocking performance. While FIG. 1 depicts the textile substrate 12, UV blocking agent 14 and capping agent 16 as distinct layers in FIG. 1, it should be understood that FIG. 1 is merely conceptual. In practice, the blocking agent 14 and capping agent 16 will permeate the textile substrate 12 and its fibers and will bind throughout the fibers in a uniform manner.

In some embodiments, the second composition may be omitted. For example, the second composition may not be necessary if a color change caused by the first composition is not a concern, such as if the substrate does not need to maintain a white or mostly white color or if the color change resulting from the use of the first composition is unimportant or is desired.

The first composition can include one or more compounds. For example, the first composition may include one or more UV absorbing chemicals, such as a mixture of UV absorbing chemicals. Chemicals which may be included in the first composition may include one or more of organic acids, proteins, flavonoids, and/or polyphenolic compounds, which may be in combination with one or more stabilizers, such as organic and/or inorganic stabilizers including but limited to sodium phosphate, alginate, and sucrose.

The UV absorbing compounds included in the first composition may have the ability to absorb UV radiation through reactive groups including but not limited to aromatic rings and conjugated double bonds. Examples of UV absorbing polyphenolic compounds which may be included in the first composition include but are not limited to gallic acid, tannic acid, dopamine, caffeic acid, salicylic acid, ferulic acid, and other aromatic acids. Examples of capping compositions that may be included in the second composition include organic and inorganic capping agents including but not limited to alkylbenzene based surfactants, phenylethanoids such as tyrosol, natural monophenols such as carnosol, and naturally derived proteins such as whey and casein.

Figure 2:
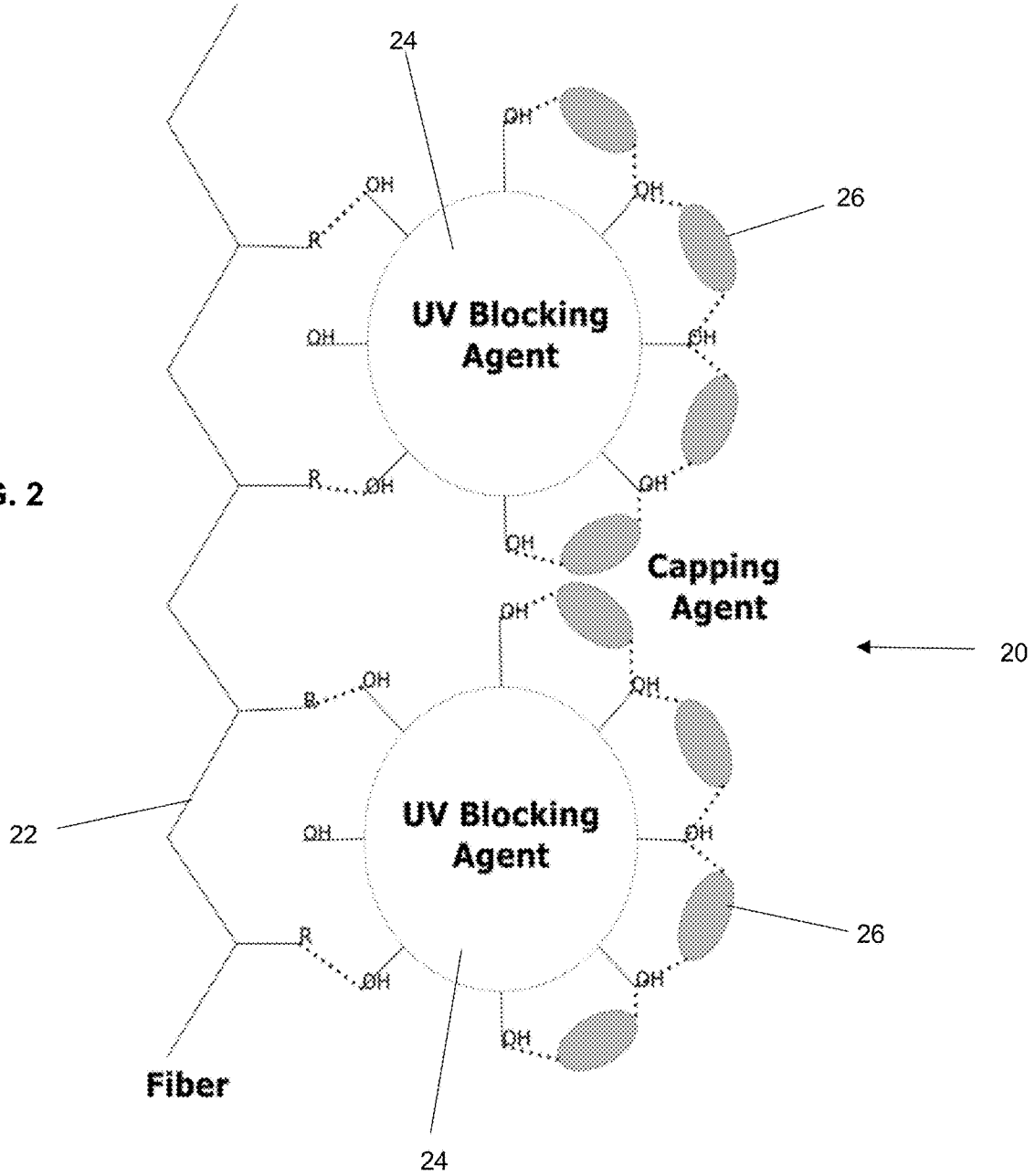
FIG. 2 is representative chemical structure of a fiber bound to a UV Blocking agent which is also bound to a capping agent according to various embodiments.

An example of a treated fiber 20 is shown in FIG. 2. The treated fiber 20 includes a fiber 22, a UV blocking agent 24, and a capping agent 26. In this example, hydroxyl groups of the UV blocking agent 24 are bound to R groups of the fiber 22 to cover the fiber 22 and provide UV protection to the fiber 22. Other hydroxyl groups of the UV blocking agent 24 which did not bind to the fiber 22 are bound to a capping agent 26. Binding of the open hydroxyl groups to the capping agent 26 blocks the open hydroxyl groups of the UV blocking agent 24 from other interactions, such as interactions that could cause discoloration and/or interfere its UV blocking capacity.

Without use of a capping agent, all of the unbound hydroxyl groups (and/or other reactive groups) of the UV blocking agent remain open and may interact with components in detergent, for example, potentially causing significant discoloration of the fiber. The use of the capping agent blocks access to some or all of the reactive groups of the UV blocking agent, reducing or preventing interaction with other compositions and the resultant discoloration. The use of the capping agent therefore allows the use of UV blocking agents on materials where such use might otherwise be avoided due to the eventual discoloration of the material.

Various materials may be substrates which are functionalized using the methods described herein. The UV blocking compounds may use oxygen, nitrogen, or hydrogen functional groups of the material to form effective bonds with the active UV blocking agent. Materials that do not have these surface groups, such as metals, some plastics, and glass will not be affected by the treatment.

The process described herein provides protection against ultraviolet radiation to the material itself and to a consumer, with the resulting ultraviolet protection of the consumer dependent on the form of the final product, including but not limited to fiber density, coverage factor, and material blends. In some embodiments, the treated knit or woven textile may provide a coverage factor of about 97% to about 100%.

In some embodiments the treated material may be porous while in others it may be nonporous. The treated material may be a synthetic or a natural textile including synthetic, semi-synthetic, or natural woven or non-woven textiles, fibers, or microfibers. Examples of textiles which may be used include cotton, polyester, nylon, spandex, rayon, linen, cashmere, silk, wool, acrylic, modacrylic, olefin, acetate, polypropylene, polyvinyl chloride, lyocell, latex, and aramid, as well as blends or combinations of one or more of these or other materials or fibers. As such, the textile may be natural, such as silk, wool, cotton, cellulosics, flax, jute or bamboo, may be synthetic, such as nylon, polyester, acrylic, spandex, rayon, a polymer such polypropylene, polyurethane, or a combination of more than one of these. In some embodiments, the material may be a textile that is a blend of different materials including those listed above.

In some embodiments, the treated material may be a sheet. The sheet may be comprised of organic and/or inorganic components. In some embodiments, the organic material sheet may be a paper material. In some embodiments, the organic material sheet may additionally include inorganic components which may be in the form of nanoparticles, coatings and/or fibers, for example.

In some embodiments, the first composition and optional second composition may bind with a porous support material such as a sheet-like material like a textile. The porous support material may be cotton, cellulose, viscose, silk, aramid, nylon, polypropylene, polystyrene, polyester, polyurethane, polyamide, polyethylene, polycarbonate, or a combination of two or more of these or other materials such as those disclosed herein. This binding can be achieved through covalent interactions, hydrogen bonding, or electrostatic interactions, for example.

In some embodiments, the treated material comprising a sheet with the bound composition(s) is a UV resistant sheet that may be used as a product or as a component of a product. The UV resistant sheets may be present as layers such as single, double, triple, or greater numbers of sheets arranged alone or layered with other UV resistant sheets or other sheets or materials.

Treated materials according to various embodiments may be used as UV protective garments, such as hats, shirts, pants, jackets, scarves, and swim wear. In other embodiments, the UV protection of the treated material may reduce or prevent UV damage to the material itself, such as in products used outdoors and/or exposed to the sunshine, where the UV protection may reduce or prevent fading, for example. In some such embodiments, the treated materials may be used in furniture upholstery, car or other vehicle upholstery, tents, tarps, umbrellas, towels, blankets, bedding, drapery and other window treatments, and awnings, for example.

Figure 3:
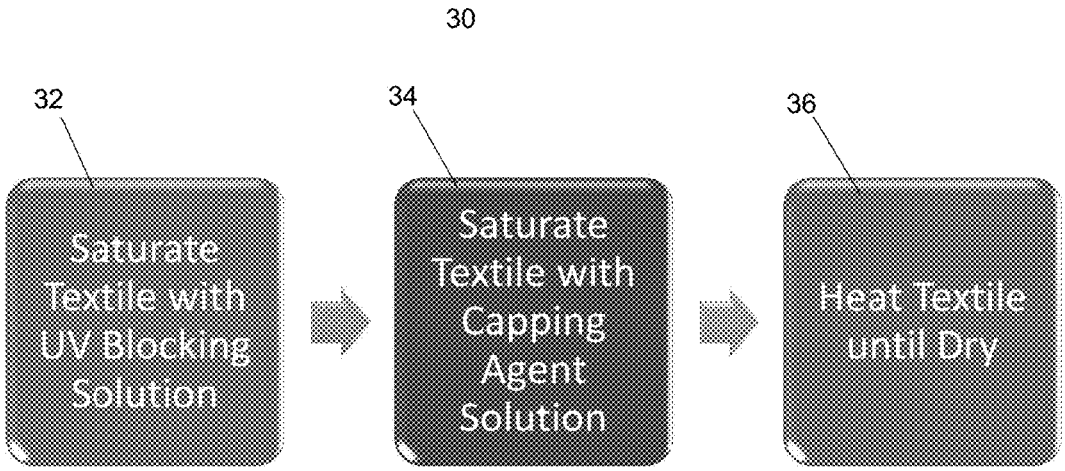
FIG. 3 is an example of a method of making a UV resistant textile according to various embodiments.

An example of a functionalization process 30 for creating a UV resistant material is shown in FIG. 3. In a first step 32, a material such as a textile is saturated with the first composition which includes the UV blocking agent to impregnate the material with the composition. The impregnation of the textile with UV absorbing organic chemicals can be done by immersion or by spraying, for example. In some embodiments the first composition is a suspension or a solution such as an aqueous suspension or solution, with a concentration ranging from about 0.005% to about 5%, or from about 0.5% to about 2%, such as about 0.8% or about 2% by weight of the composition. While the composition is aqueous in many embodiments, it may alternatively be non-aqueous, such as a dilute solution (such as less than 50% or less than 25%) of an organic solvent such as acetone, ethanol, or isopropanol. Applying the first composition to the textile may include saturating the textile with the composition, such as by soaking the textile in the first composition or spraying the first composition onto the support material.

In a second step 34, the textile is saturated with a second composition which includes a capping agent. As in the first step 32, the saturation with the second composition can be done by immersion or by spraying, for example. In some embodiments the composition is in a suspension or a solution such as an aqueous suspension or solution, with a concentration ranging from about 0.05% to about 15%, or from about 1% to about 4%, such as about 2.5% or about 3% by weight of the composition. While the composition is aqueous in many embodiments, it may alternatively be non-aqueous, such as a dilute solution (such as less than 50% or less than 25%) of an organic solvent such as acetone, ethanol, or isopropanol. Applying the composition to the material may include saturating the support material with the composition, such as by soaking the material in the composition or spraying the composition onto the support material.

In a third step 36, the textile is dried such as through heating to bind the compositions to the textile and to each other. For example, the composition may be bound to the textile through drying and/or through the application of heat such as through the use of a heat dryer. The heating process can occur within the ranges of about 50 degrees C. to about 150 degrees C., for example, depending on the thermal stability of the substrate material being treated. The heat may cause evaporation of the solution to initiate chemical binding between the substrate and the UV blocking compound and the capping agent.

Although not shown in FIG. 3, the functionalization process may alternatively include an additional intermediate drying step after the first step 32 and before the second step 34. That is, after saturation of the material with the first composition, the material may be dried such as through the application of heat to bind the UV blocking agent to the material. This application of heat may be as described above with regard to the third step above in FIG. 3. The material with the bound UV blocking agent may then be saturated with the second composition and then dried as described above with regard to steps 2 and 3 of FIG. 3.

Figure 4:
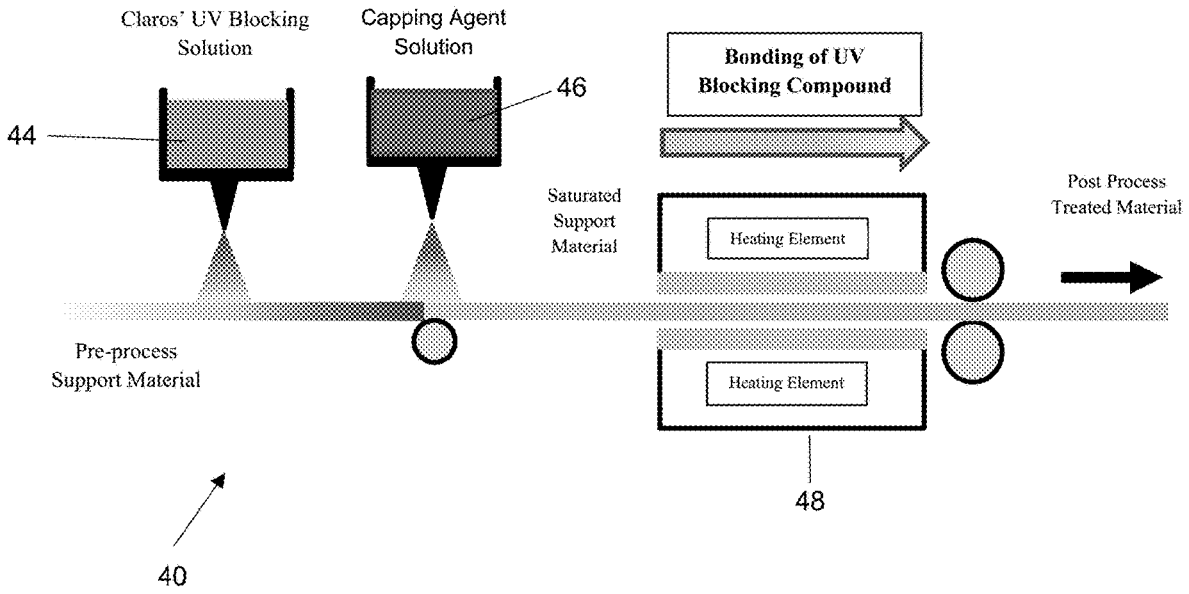
FIG. 4 is an example of a scheme for treating fabric using a manufacturing line according to various embodiments.

In some embodiments, the process of functionalizing the material with a UV blocking compound may be performed using a continuous process and at a large scale, such as through the process depicted in FIG. 4. The support material 42 may be continuously conveyed such as on a conveyor belt of a manufacturing line. In this example, the process begins on the left with a pre-process support material. As the support material is conveyed from the left to the right, a first composition 44 comprising a UV blocking solution is applied to the material 42 through spraying, and then the second composition 46 comprising the capping agent solution is applied through spraying as the material 42 continuously progresses through the line. The saturated support material is then conveyed through a heating element 48 for bonding of the UV blocking compound to the support material and bonding of the capping agent to the UV blocking compound. The post process treated material exits the manufacturing line on the right and may be used for production of products.

Various embodiments may use commercial or industrial dryers which may be capable of drying large quantities of material, such as large quantities of textiles, and operating for longer periods, such as continuously throughout the day. For example, such commercial dryers may have larger drying cylinder sizes, higher airflow, and higher BTU ratings which may help to reduce drying time and increase drying efficiency. In some embodiments, the dryer may apply heat to the material. In some embodiments, the dryer may blow heated air toward the material and/or move the material while drying such as on a conveyor or by tumbling within the dryer. The source of heat may additionally or alternatively be an oven, dryer, a heat jet, or a source of infrared light, for example.

Following heat treatment, the UV blocking composition may remain bound to the material for an extended period of time. For example, the composition may remain bound to the material during 50 or more subsequent uses and/or washes such as laundry cycles.

EXPERIMENTAL

Example 1

An uncolored 100% cotton fabric acquired from Test Fabrics LLC was submerged in a bath of aqueous solution containing 1% by weight of a polyphenolic compound, tannic acid. The fabric was then removed and placed in an aqueous solution bath containing 3% by weight of a protein capping agent, sodium caseinate, and immediately placed on a conveyor dryer for heating. Heating was performed at a temperature of 150 degrees C. until the fabric was fully dry. A visible change was noted, in which the color had turned a light brown/yellow color.

The fabric, before and after treatment, was measured for UV transmittance in the range of 280-400 nm utilizing a Shimadzu UV-2600i with integrating sphere, with the ultraviolet protection factor (UPF) value being calculated in accordance with the EN13758 method. The treated fabric was then washed in a commercial laundry/dryer system following the AATCC LP1 protocol utilizing standard AATCC 1993 detergent with optical brightener and measured for UV transmittance. The results are shown below in Table 1.

TABLE 1

| Ultraviolet Protection Factor (UPF) of treated 100% cotton fabric | | | |
|---|---|---|---|
| | Control | Treated Unwashed | Treated Washed |
| UPF Value | 5.4 | 75.1 | 150.9 |

Photographs of the fabric are shown in FIG. 6. The untreated control is on the left. The fabric in the center is after treatment and has a yellowish discoloration. The fabric on the rights is after treatment and washing and shows some additional beige discoloration.

UPF spectra results are presented in FIG. 5, comparing the UV transmittance of the untreated control sample to the treated fabric before and after washing. The top line is the control and has the highest transmittance. The middle line, with much lower transmittance, is the treated fabric without washing. The bottom line, with the lowest transmittance, is the treated fabric after washing.

Example 2

An uncolored cotton/polyester (approximately 50/50) fabric acquired from an outdoor consumer wear brand was submerged in a bath of aqueous solution containing 0.8% by weight of a polyphenolic compound, tannic acid. The fabric was then dried on a conveyor dryer at a temperature of approximately 100 degrees C. The sample was then placed in an aqueous solution bath containing 2.5% by weight of a casein protein capping agent, and immediately placed on a conveyor dryer for heating. Heating was performed at a temperature of 150 degrees C. until the fabric was fully dry. The treated fabric was then washed in a commercial laundry/dryer system following the AATCC LP1 protocol utilizing standard AATCC 1993 detergent with optical brightener.

Figure 8:
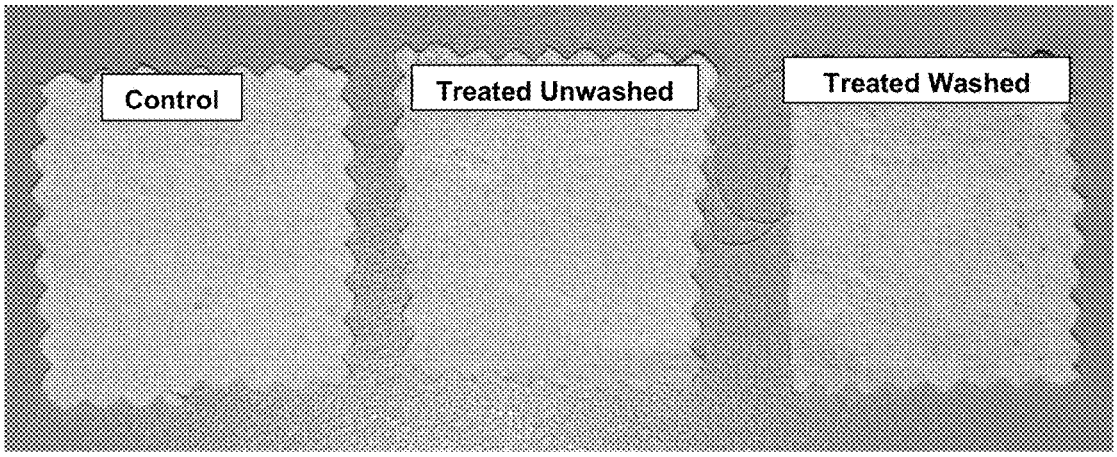
FIG. 8 is a photograph of cotton/polyester blend control and treated fabric samples resulting from Example 2.

As can be seen in the photographs presented in FIG. 8, the treatment resulted in a visible change. The control fabric is on the left. The fabric in the middle is the treated fabric without washing and it has a slight beige tint as compared to the control fabric. The fabric on the right is the treated fabric after washing and has a more beige tint than the treated fabric. A visible change was noted, in which the color of the textile had turned a light brown/yellow color.

Figure 7:
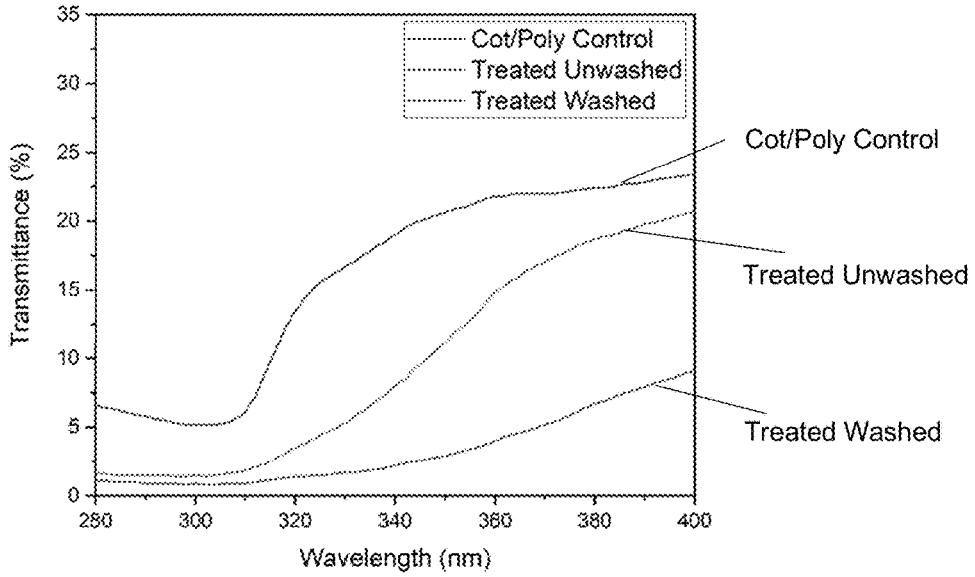
FIG. 7 is a graph of transmittance vs wavelength of cotton/polyester blend control and treated fabric samples resulting from Example 2.

The control and the treated fabrics were measured for UV transmittance in the range of 280-400 nm utilizing a Shimadzu UV-2600i with integrating sphere, with the UPF value being calculated in accordance with the EN13758 method. The resulting spectra, shown in the graph presented in FIG. 7, compares the UV transmittance of an untreated control sample (top line) to the treated fabric without washing (middle line). The UV transmittance of the treated and washed sample is the bottom line. The UPF results are shown below in Table 2.

TABLE 2

| Ultraviolet Protection Factor (UPF) of treated cotton/polyester blends | | | |
|---|---|---|---|
| | Control | Treated Unwashed | Treated Washed |
| UPF Value | 25 | 55.6 | 72.3 |

The results of Examples 1 and 2 indicate that the treatment process resulted in much lower UV transmittance and an increased UPF as compared to the untreated material. Washing the treated material resulted in an additional color change, even lower transmittance and even higher UPF, likely due to some degree of additional reaction occurring between reactive sites on the UV blocking agent which were not bound by the capping agent and a component of the detergent, though this is expected to stabilize over time. As such, while these results suggest that the capping agent did not prevent all interactions with the UV blocking agent, the discoloration which resulted was only slight, suggesting that the capping agent successfully protected interactions with the UV blocking agent to reduce and minimize any resulting color change.

As used herein, the terms "substantially" or "generally" refer to the complete or near complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is no significant effect thereof.

In the foregoing description various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide illustrations of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. An ultraviolet protective textile comprising:

a sheet substrate comprising a synthetic, semi-synthetic or natural textile or blend thereof;

a UV absorbing chemical present on the substrate and directly bound to the substrate; and a capping agent comprising a naturally derived protein, the capping agent bound to reactive groups of the UV absorbing chemical, wherein the capping agent blocks access to the reactive groups of the UV absorbing chemical to reduce or prevent interaction with other compositions.

2. The ultraviolet protective textile of claim 1 wherein the UV absorbing chemical comprises an organic acid, protein, flavonoid, or a polyphenolic compound.

3. The ultraviolet protective textile of claim 1 wherein the UV absorbing chemical comprises an aromatic acid.

4. The ultraviolet protective textile of claim 1 wherein the UV absorbing chemical comprises gallic acid, tannic acid, caffeic acid, dopamine, salicylic acid, or ferulic acid.

5. The ultraviolet protective textile of claim 1 wherein the UV absorbing chemical comprises tannic acid.

6. The ultraviolet protective textile of claim 1 wherein the capping agent comprises an alkylbenzene based surfactant, phenylethanoid, monophenol, or protein.

7. The ultraviolet protective textile of claim 1 wherein the naturally derived protein comprises whey or casein.

8. The ultraviolet protective textile of claim 1, the ultraviolet protective textile comprising a garment configured to be worn on the body of a user.

9. The ultraviolet protective textile of claim 1 wherein the ultraviolet protective textile has a coverage factor of about 97% to about 100%.

10. The ultraviolet protective textile of claim 1 wherein the sheet substrate comprises an organic porous material.

11. The ultraviolet protective textile of claim 10 wherein the organic porous material further comprises inorganic components in the form of nanoparticles, coatings, or fibers.

12. The method of making an ultraviolet protective material comprising the steps of:

a. applying an ultraviolet absorbing organic compound in a solution to a porous material to diffuse the ultraviolet absorbing organic compound into the porous material; and then b. applying a capping agent comprising a naturally derived caseinate in a solution to the porous material to diffuse the capping agent into the porous material, wherein the capping agent blocks access to the reactive groups of the UV absorbing chemical to reduce or prevent interaction with other compositions; and c. drying the porous material with the applied ultraviolet absorbing organic compound solution, after step a or after step b, to bind the compound to a surface of the material and to interior fibers of the material.

13. The method of claim 12 wherein drying the porous material comprises heating the porous material.

14. The method of claim 12 wherein the ultraviolet absorbing organic compound comprises tannic acid.

15. The method of claim 12 wherein step b is performed before step c.

16. The method of claim 12 wherein step b is performed after step c, the method further comprising drying the porous material with the applied capping agent to bind the capping agent to the ultraviolet absorbing compound.

17. The method of claim 12 wherein the porous material comprises a textile.

* * * * *